United States Patent [19]

Gastgeb et al.

[11] Patent Number: 4,904,222

[45] Date of Patent: Feb. 27, 1990

[54] SYNCHRONIZED SOUND PRODUCING AMUSEMENT DEVICE

[75] Inventors: Raymond F. Gastgeb, Doylestown; Edward Tom, Philadelphia, both of Pa.

[73] Assignee: Pennwalt Corporation, Philadelphia, Pa.

[21] Appl. No.: 186,519

[22] Filed: Apr. 27, 1988

[51] Int. Cl.[4] ..... A63H 5/00

[52] U.S. Cl. ..... 446/405; 446/408; 446/473; 446/485; 84/422.4; 84/DIG. 24; 310/331; 310/800

[58] Field of Search ..... 446/405, 397, 473, 484, 446/485; 310/800, 339, 330, 331; 84/DIG. 24, 422 S, 1.04, 1.06, 1.14

[56] References Cited

U.S. PATENT DOCUMENTS

| | | | |
|---|---|---|---|
| 2,944,117 | 7/1960 | Gray | 84/DIG. 24 X |
| 3,394,491 | 7/1968 | Valentine . | |
| 3,750,127 | 7/1973 | Ayers et al. | 340/261 |
| 3,969,927 | 7/1976 | Yoshida et al. | 73/71.4 |
| 4,278,000 | 7/1981 | Saito et al. | 84/1.16 |
| 4,488,873 | 12/1984 | Bloomfield et al. | 433/71 |
| 4,499,394 | 2/1985 | Koal | 310/800 X |
| 4,536,674 | 8/1985 | Schmidt | 310/330 |
| 4,538,139 | 8/1985 | Clemente | 340/539 |
| 4,585,970 | 4/1986 | Koal et al. | 310/331 |
| 4,678,450 | 7/1987 | Scolari et al. | 446/405 |
| 4,700,602 | 10/1987 | Bozzio | 84/DIG. 24 X |
| 4,748,366 | 5/1988 | Taylor | 310/800 X |

FOREIGN PATENT DOCUMENTS

| | | | |
|---|---|---|---|
| 2183076 | 5/1987 | United Kingdom | 84/422 S |

*Primary Examiner*—Mickey Yu

*Attorney, Agent, or Firm*—Bernard F. Plantz

[57] ABSTRACT

An amusement device is disclosed which contains a signal generator attached to a flexible member. When the flexible member is repeatedly waved, an oscillatory electrical signal is produced by the signal generator and supplied to a sound generator which produces sound which synchronously varies with the repeated flexure of the member caused by the waving action. The sound generator produces a first tone with respect to the oscillatory electrical signal and a second tone when the frequency of the oscillatory electrical signal exceeds a predetermined value.

12 Claims, 4 Drawing Sheets

SYNCHRONIZED SOUND PRODUCING AMUSEMENT DEVICE

BACKGROUND OF THE INVENTION

The present invention relates to an amusement device and, more particularly, to a toy sword or drumstick which produces sound which is synchronized with the movement of the device.

Toys which emit sound and/or light have been very popular with children over the years. These devices typically contain a mechanical switch which is activated by the child to control a power supply connected to a sound generator or a lamp. An example of such a device is described in U.S. Pat. No. 4,678,450 to J. E. Scolari et al. This toy is in the form of a light sword which contains a mechanical switch on the handle to control the operation of a strobe lamp. Additionally, the sword contains an inertial switch within the sword blade. When the sword blade is moved sideways and its movement is interrupted, such as by contacting an object, the inertial switch closes to fire a strobe lamp and to generate sound from a sound generator.

Toys have also been marketed which produce a varied response, rather than an on-off type operation, when played with by a child. An example of this type of device is disclosed in U.S. Pat. No. 3,394,491 to A. J. Valentine. This toy is in the form of a space weapon which contains a switch which activates a sound generator so as to produce an audio response having a fixed frequency. The device also contains a potentiometer which is connected to a knob which can be manipulated by the child. When this knob is rotated, the frequency of the note generated by the sound generator is varied. Thus, this device allows a child to produce a constant sound of a fixed frequency, a constant sound of a varying frequency, or an intermittent sound of constant or varying frequency.

It would be desirable to have a toy which produces sound which automatically varies when a child plays with the device. The varying sound would be synchronized with the movement of the toy and would not require the manipulation of a mechanical switch.

SUMMARY OF THE INVENTION

The amusement device of the present invention comprises a signal generating means attached to a flexible member for producing an oscillatory electrical signal when the flexible member is repeatedly flexed. A sound generating means is provided for producing sound in response to the electrical signal which synchronously varies with the repeated flexure of the flexible member.

As further embodiments of the present invention, the flexible member may take the shape of an article which may be hand held, such as a toy sword or drumstick. When these hand held flexible members are waved by hand, a sound which is synchronized with the waving of the device is produced. A light generating means may optionally be connected to the signal generating means for producing a light response which synchronously varies with the repeated flexure of the flexible member.

DETAILED DESCRIPTION OF THE PREFERRED EMBODIMENTS

Figure 1:
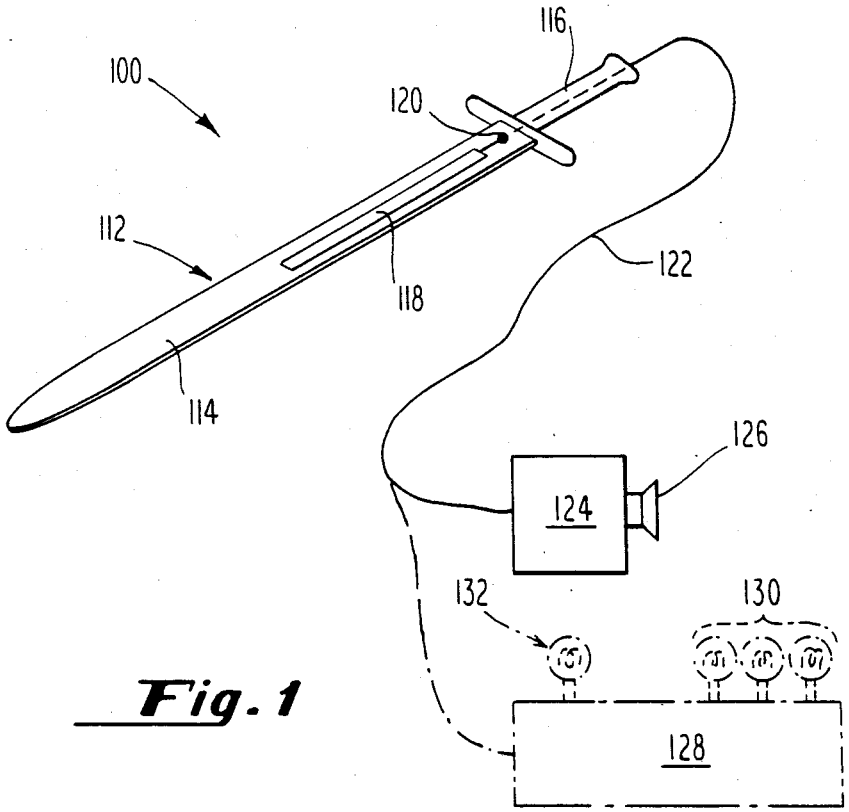
FIG. 1 is a perspective view of the first embodiment of the amusement device of the present invention wherein the flexible member is in the shape of a toy sword.

Referring now to FIG. 1, the amusement device of the present invention is generally designated as 100. More particularly, as a first embodiment of the present invention, a toy sword 112 is shown with a flexible blade portion 114 and a handle portion 116. The blade portion 114 is fabricated from a flexible material, such as polycarbonate resin sheet available from the General Electric company under the trademark LEXAN, so that when the sword 112 is repeatedly waved by hand, repeated flexure occurs along the blade portion 114. The handle 116 may be of the same material as the blade 114 or of a more rigid material.

A signal generating means, such as a flexible piezoelectric element 118, is attached to the blade 114 for producing an oscillatory electrical signal when the blade 114 is repeatedly flexed, such as when it is repeatedly waved by hand or caused to vibrate when it strikes an object. An opening 120 is provided in the blade portion 114 and through the handle portion 116 so that a cable 122 can electrically connect the flexible piezoelectric element 118 to the sound generating means 124 containing the speaker 126.

When the sword 112 is held by the handle 116 and waved repeatedly, repeated flexure occurs along the blade 114. This repeated flexure is transmitted to the flexible piezoelectric element 118. The flexure within the piezoelectric element 118 produces an oscillatory electrical signal which is supplied to the sound generating means 124. The amplitude and frequency of the oscillating electrical signal are directly proportional to the amplitude and rate of flexure of the blade 114. The sound generating means 124 contains circuitry which in response to the electrical signal from the piezoelectric element 118 produces sound through the speaker 126 which synchronously varies with the repeated flexure of the blade 114. Furthermore, if the blade 114 contacts a stationary object, a high frequency vibration is transmitted through the blade 114 to the piezoelectric element 118 which in turn causes a burst of sound to be emitted by the sound generating means 124.

As shown by the dotted line portion of FIG. 1, an optional light generating means 128, including a light bar 130 and a single lamp 132, may be electrically connected to the flexible piezoelectric element 118. This light generating means 128 produces a light response which synchronously varies with the repeated flexure of the blade 114. A plurality of lamps in the form of a light bar 130 are sequentially lit to produce a synchronized light response. When a high frequency vibration is transmitted to the piezoelectric element 118, a burst of light is emitted from the lamp 132. The light bar 130 and the lamp 132 of the light generating means 128 may also be positioned on the blade portion 114 of the sword 112.

The flexible piezoelectric element 118 used in the present invention is a piezoelectric polymer film, such as polyvinylidene fluoride (PVDF), with electrodes formed thereon. The electrodes are typically electroconductive layers, such as a thin film metal or a conductive polymer, which are applied to opposing sides of the piezoelectric polymer film. Polyvinylidene fluoride is approximately 50% crystalline and 50% amorphous. The principal crystalline forms of PVDF are the highly polar $\beta$ form and the non-polar $\alpha$ form. High piezoelectric response is associated with the polar $\beta$ form. In order to increase the piezoelectric properties of polyvinylidene fluoride, the film is mechanically orientated and subject to an intense electrical field, otherwise known as poling, to cause the oriented $\beta$ form crystallites to predominate. The piezoelectric polymer films used in the present invention are typically orientated $d_{31}$. Piezoelectric polymer films which have been treated in this manner are available from the Pennwalt Corporation, Philadelphia, PA, under the trademark KYNAR. Other suitable piezoelectric polymers useful in the present invention include copolymers of vinylidene fluoride and copolymerizable comonomers, such as tetrafluoroethylene and trifluoroethylene.

As is conventionally known, when piezoelectric polymeric films are flexed, such that the film is put in compression and/or tension, a voltage is produced due to the change in the surface charged density of the polymeric material. When force is applied to the film, such as when the sword blade is repeatedly waved or caused to vibrate after it strikes an object, the repeated flexure of the piezoelectric polymeric film produces an oscillatory voltage output. This oscillatory electrical signal is then supplied to the sound generating means 124.

Figure 2:
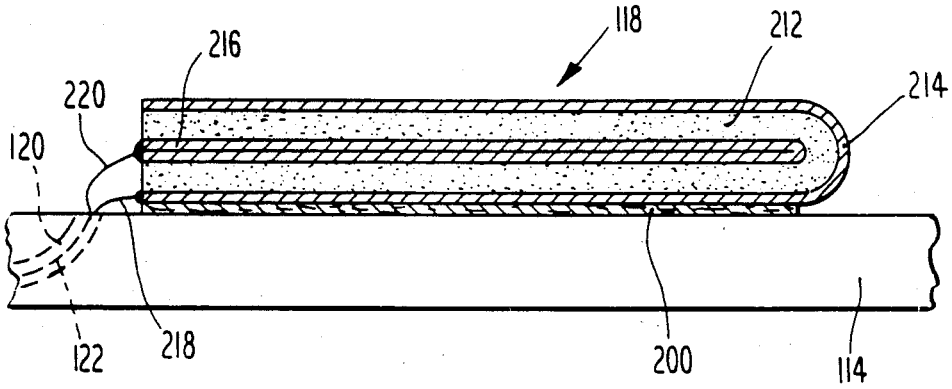
FIG. 2 is a partial side view of the toy sword shown in FIG. 1 illustrating the flexible piezoelectric element attached to the sword blade.

Referring now to FIG. 2, the attachment of the flexible piezoelectric element 118 to the blade 114 is shown. The piezoelectric polymer film 212 contains opposed electroconductive layers 214 and 216. This piezoelectric polymeric film is then folded in the manner shown such that the electroconductive layer 216 is in a face-to-face relationship. The electroconductive layer 212 is glued together with a suitable adhesive, such as cyano acrylate, epoxy or the like. The bottom portion of the other electroconductive layer 214 is then attached to the flexible blade 114 with double-sided tape 200 or other suitable adhesives, such as 3M 6065 spray adhesive. Alternatively, the flexible piezoelectric element may be integrally formed within the blade by moulding the blade material around the piezoelectric element. The flexible blade 114 contains a hole 120 for the cable 122 to pass through. The cable 122 consists of two separate strands of conductors 218 and 220. The conductors 218 and 220 are attached to the electroconductive layers 214 and 216, respectively, with rivets, conductive tape or conductive epoxy. The conductor 218 is connected to ground while the conductor 220 is used to transmit the oscillatory electrical signal. As can be seen in FIG. 2, any flexure which is experienced along the blade 114 is transmitted to the piezoelectric element 118 since this element is intimately affixed to the blade.

Figure 3:
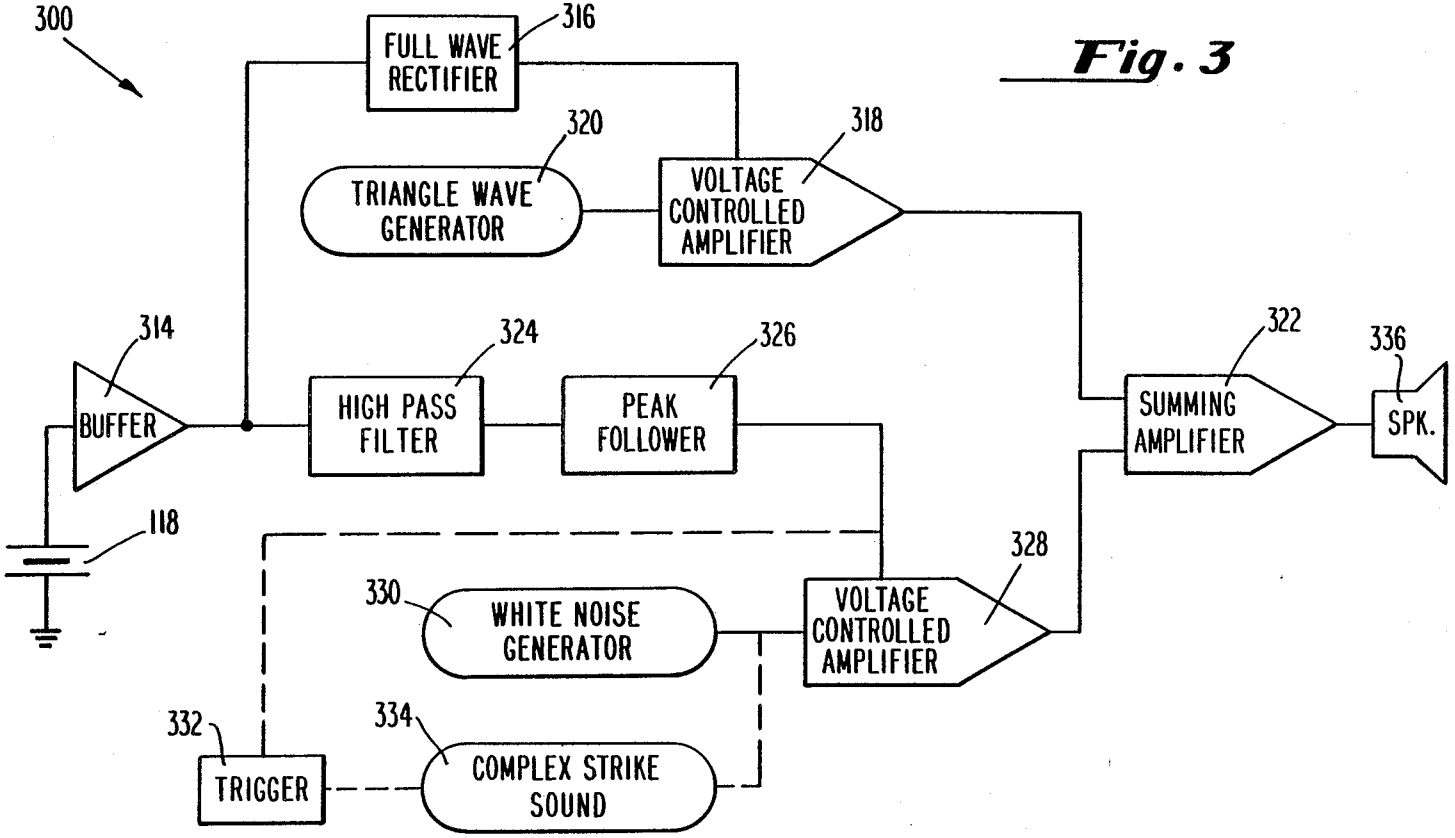
FIG. 3 is a block diagram showing the speaker and the electrical circuitry used for producing the synchronized sound.

Referring now to FIG. 3, the sound generating means 124 for producing sound which synchronously varies with the repeated flexure of the sword blade is generally designated as 300. The flexible piezoelectric element 118 has a first electroconductive layer which is connected to ground while the second electroconductive layer is electrically connected to a buffer 314 to adjust the impedance between the signal produced by the piezoelectric element and the remainder of the circuitry. A portion of the signal from the piezoelectric film is then passed through a full wave rectifier 316. The rectified electrical signal is then supplied to a voltage control amplifier 318. The voltage controlled amplifier 318 is electrically connected to a triangle wave generator 320. Thus, as the voltage of the oscillatory electrical signal varies, the amplification or volume of the sound produced by the signal supplied by the triangle wave generator 320 also varies. When the sword blade is repeatedly flexed to produce a signal which saturates the voltage controlled amplifier 318, the tone of the sound produced by the speaker 336 may also vary.

A second portion of the oscillatory electrical signal which passes through the buffer 314 is supplied to a high pass filter 324. This high pass filter filters out all frequencies below 300 hertz. The high frequency signal is then passed through a peak follower 326 to a voltage controlled amplifier 328. A white noise generator 330 is electrically connected to the voltage controlled amplifier 328. When the oscillatory electrical signal has a frequency of greater than 300 hertz, white noise is supplied to the summing amplifier 322. The volume of the white noise also varies proportionally with the voltage of the oscillatory electrical signal. This portion of the circuit produces a spontaneous burst of sound when the flexible sword blade strikes an object causing the blade and the piezoelectric element to vibrate at a frequency greater than 300 hertz.

The signals from the voltage controlled amplifiers 318 and 328 are then supplied to a summing amplifier 322. The output signal from the summing amplifier 322 is then used to drive the speaker 336 which emits sound which synchronously varies with the repeated flexure of the sword blade.

As an alternative embodiment, the high frequency side of the circuitry 300 may contain both a trigger 332 and a complex strike sound 334, such as AY-3-8910A available from Radio Shack. These are shown as being electrically connected by the dotted line portion. This optional circuitry adds an additional component to the sound when the frequency of flexure transmitted to the piezoelectric element is greater than 300 hertz.

As can be seen by the block diagrams, the volume of the sound emitted from the speaker 336 is proportional to the amplitude of flexure of the piezoelectric element 118. Additionally, the frequency of the repeated flexure of the piezoelectric element influences whether sounds of different tones and frequencies are heard. Thus, in the arrangement shown in FIG. 3, when the sword is slowly moved side-to-side, changes in the volume of the sound produced by the speaker 336 are synchronized with this movement. When the sword contacts an object and produces a high frequency vibration, an additional sound component from the white noise generator is added.

Figure 4:
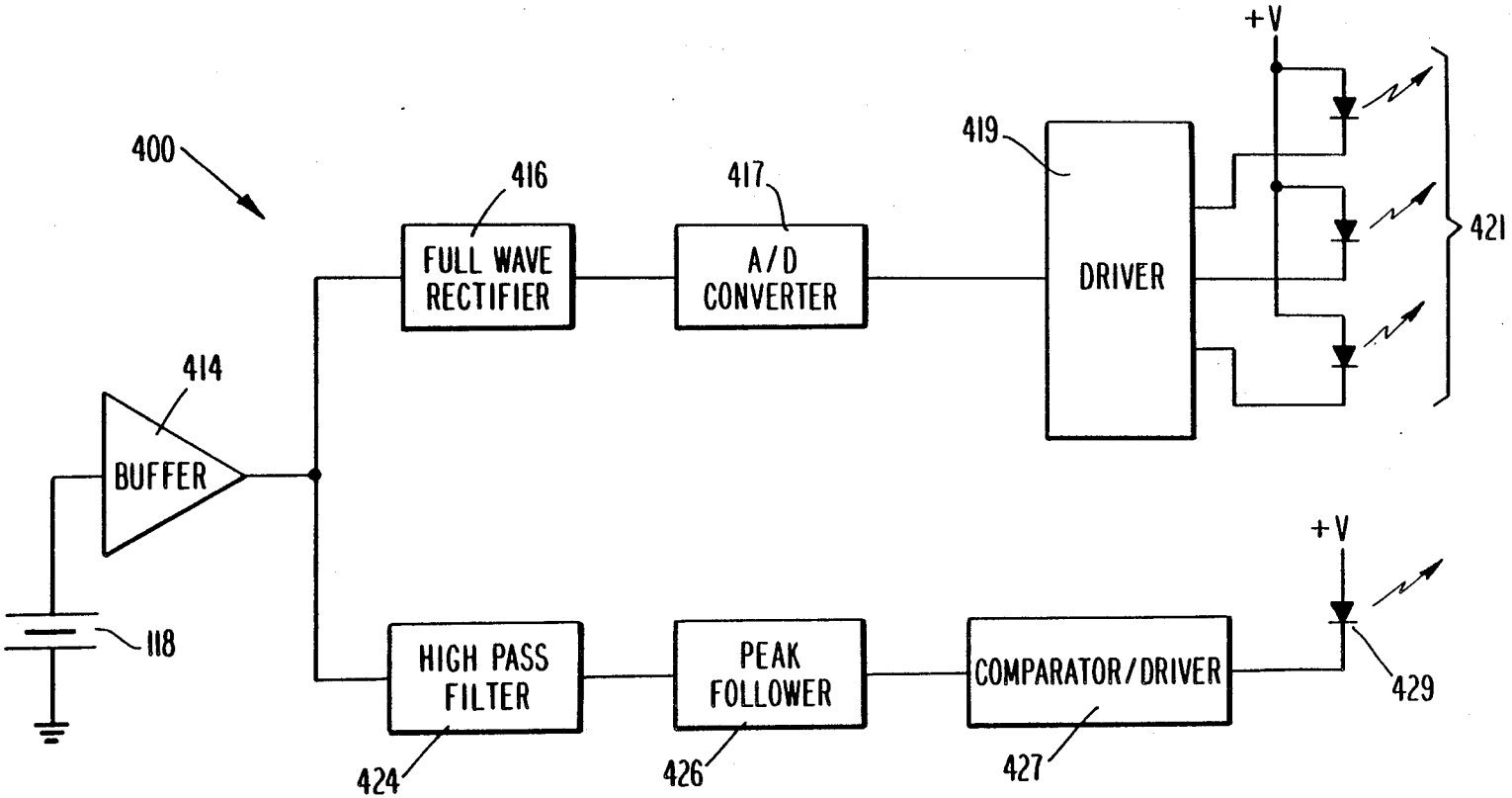
FIG. 4 is a block diagram showing the light emitting diodes and the electrical circuitry used for producing a synchronized light response.

Referring now to FIG. 4, the light generating means for producing a light response which synchronously varies with the repeated flexure of the sword blade is generally designated as 400. A buffer 414 is used to match the impedance between the flexible piezoelectric element 118 and the remainder of the circuitry. A portion of the signal from the piezoelectric film is then passed through a full wave rectifier 416. The rectified electrical signal is supplied to an analog to digital converter 417. The digitized signal is then supplied to a driver 419, such as ULN 2003 available from Texas Instruments, which controls the lighting of a light bar 421. The light bar 421 is made up of a plurality of light emitting diodes which are sequentially lit with the repeated flexure of the sword blade. The amplitude of the flexure of the sword blade and the attached piezoelectric element 118 determines how many of the diodes are lit.

A portion of the oscillatory is also supplied to a high pass filter 424 which allows signals in excess of 300 hertz to pass to a peak follower 426. The output from the peak follower 426 is supplied to a comparator/-driver circuit 427 which controls the lighting of a light emitting diode 429. Thus, if an oscillatory electrical signal in excess of 300 hertz is produced, such as when the sword contacts an object and produces a high frequency vibration, a light response will also be produced by the light emitting diode 429.

Figure 5:
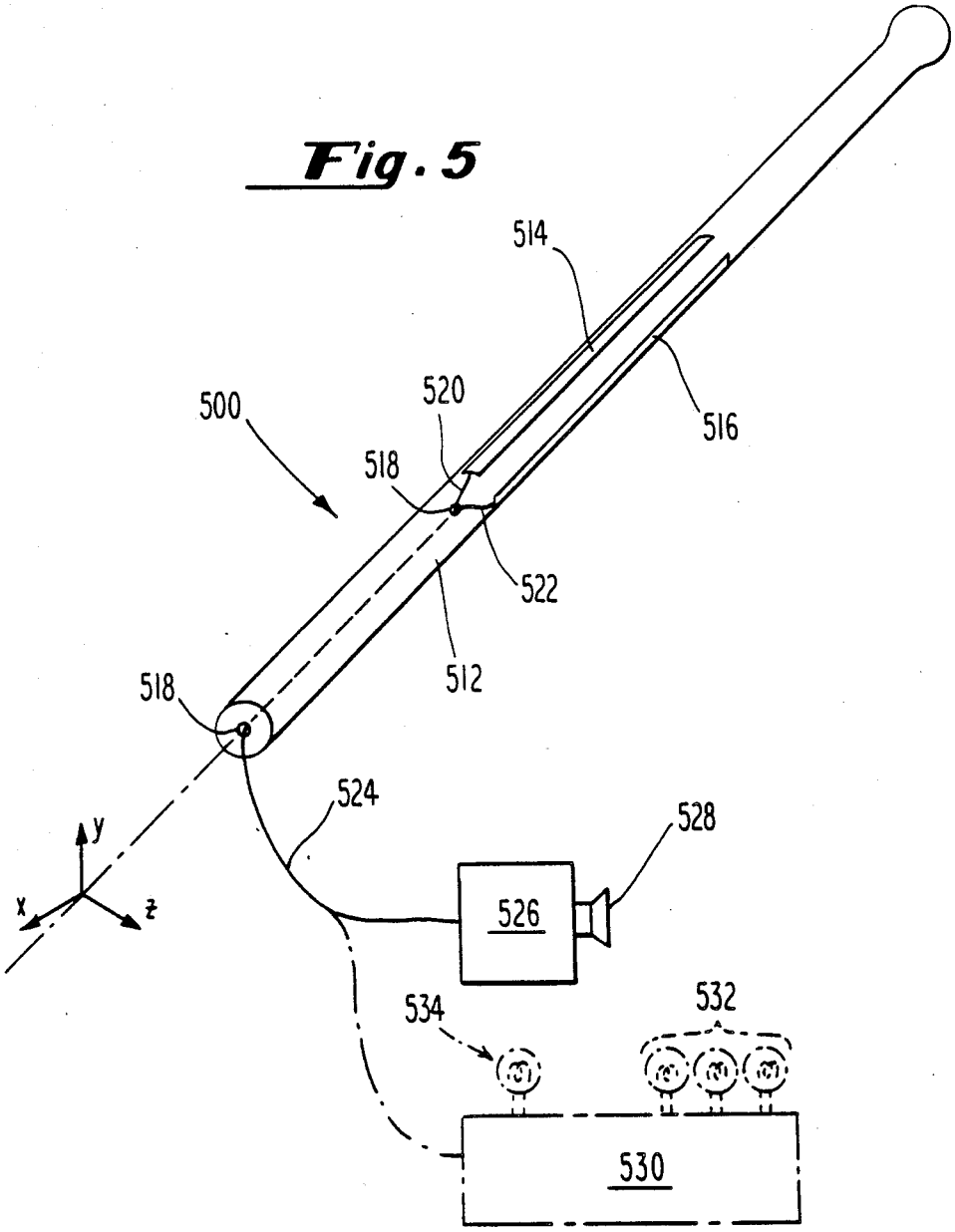
FIG. 5 is a perspective view of the second embodiment of the amusement device of the present invention wherein the flexible member is in the form of a drumstick.

Referring now to FIG. 5, a second embodiment of the present invention generally designated as 500 is shown. The flexible member 512 is in the shape of a drumstick. This drumstick 512 may be fabricated from a flexible material, such as wood or LEXAN®. The drumstick 512 contains a first flexible piezoelectric element 514 and a second flexible piezoelectric element 516. The first and second flexible piezoelectric elements 514 and 516, respectively, are fabricated and attached to the drumstick 512 in the manner described earlier with regard to the flexible piezoelectric element 118 shown in FIG. 2. The flexible piezoelectric elements may also be integrally formed within the drumstick 512.

As shown in FIG. 5, the first and second piezoelectric elements 514 and 516, respectively, are substantially parallel to the longitudinal axis of the drumstick 512. When the drumstick 512 is repeatedly waved in the XY plane, flexure occurs in the first piezoelectric element 514 about the Z axis. This first piezoelectric element 514 produces a first oscillatory electrical signal. When the drumstick 512 is waved repeatedly in the XZ plane, repeated flexure occurs about the Y axis in the second piezoelectric element 516. This movement in the XZ plane produces a second oscillatory electrical signal. If the drumstick strikes an object when it is moving in the appropriate plane, the induced vibration also causes repeated flexure about the Y or Z axes. Leads 520 and 522 are attached to the respective piezoelectric elements so that two electrical signals are transmitted independently through the cable 524 to the sound generating means 526 containing the speaker 528.

Separate sound generating circuits for the first and second oscillatory electrical signals are provided so that distinct sounds are produced when the drum stick is waved in the XY plane as opposed to the XZ plane and vice versa. The sound which is produced synchronously varies with the repeated flexure of the drumstick when it is waved in the appropriate plane. Electrical circuitry similar to that shown in FIG. 3 would be connected to the first and second flexible piezoelectric elements 514 and 516, respectively. However, each circuit would have distinct wave and/or other noise generators so that distinct sounds are produced when the drumstick 512 is waved in the different planes.

As an optional feature, a light generating means 530, including a light bar 532 and a lamp 534, may be connected to the flexible piezoelectric elements 514 and 516. This light generating means 530 is similar to the light generating means 128 shown in FIG. 1 and would contain circuitry similar to that shown in FIG. 4. A single light generating means 530 could be connected to one or both of the piezoelectric elements 514 and 516 so that a light response which synchronously varies with the flexure of the drumstick 512 in the appropriate plane is produced. Although FIG. 5 only shows a single light generating means 530, separate light generating means with different colored lamps may also be connected to each piezoelectric element so that the color of the light response depends on the plane in which the drumstick 512 is waved.

Signal generating means other than a flexible piezoelectric element may be used in the present invention. For example, piezoresistive, semiconductive, carbon-resistive, bonded metal wire, and foil-resistive strain gauges connected to a voltage source may be used. The strain gauge would be attached to the flexible member in the same manner as described earlier for the piezoelectric element 118. When the member is flexed, the strain gauge also flexes producing a change in electrical resistance which is proportional to the strain induced by the flexure of the member. Since the resistance of the gauge varies proportionally with the flexure of the member, the voltage output of the gauge also varies. Thus, when the gauge is repeatedly flexed, an oscillatory voltage output is achieved. The circuitry shown in FIGS. 3 and 4 would be modified by substituting a voltage source and a strain gauge for the piezoelectric element 118. The strain gauge and voltage source are typically part of a Wheatstone bridge circuit whose output is then passed through an operational amplifier before it is supplied to the buffers 314 and 414 shown in FIGS. 3 and 4, respectively.

Although the present invention has been described using either a sword or drumstick as the flexible member, objects of other shapes may be used as the flexible member without departing from the spirit and scope of the present invention. Furthermore, the electrical circuitry shown in FIGS. 3 and 4 is only illustrative of a variety of sound and light generating means which may be used in the present invention to produce sound and light which synchronously varies with the flexure of the flexible member. For example, the frequency of the tone produced by a tone generator may synchronously vary with the repeated flexure of the flexible member.

What is claimed is:

1. An amusement device, comprising:

a flexible member;

a signal generating means attached to said member for producing an oscillatory electrical signal when said member is repeatedly flexed; and a sound generating means responsive to said electrical signal for producing sound which synchronously varies with the repeated flexure of said member, said sound generating means including circuitry for producing a first tone which varies in loudness proportionally with the voltage of said oscillatory electrical signal and a second tone which varies in loudness proportionally with the voltage of said oscillatory electrical signal when the frequency of said oscillatory electrical signal exceeds a predetermined value.

2. An amusement device according to claim 1, further comprising:

a light generating means responsive to said electrical signal for producing a light response which synchronously varies with the repeated flexure of said member.

3. An amusement device according to claim 1 wherein said signal generating means comprises a flexible piezoelectric element.

4. An amusement device according to claim 3 wherein said flexible member is of a size and shape to be hand held.

5. An amusement device according to claim 3 wherein said flexible piezoelectric element is a piezoelectric polymer film having opposed electroconductive surfaces.

6. An amusement device according to claim 5 wherein said flexible member is in the shape of a sword.

7. An amusement device according to claim 5 wherein said flexible member is in the shape of a drumstick.

8. An amusement device, comprising:

a sword having a handle and a blade, said blade is fabricated from a material which flexes when the sword is waved by hand;

a flexible piezoelectric element attached to the blade of said sword for producing an oscillatory electrical signal when the blade is repeatedly flexed; and sound generating means electrically connected to said element and responsive to said electrical signal for producing sound which synchronously varies with the repeated flexure of said blade, said sound generating means including circuitry for producing a first tone which varies in loudness proportionally with the voltage of said oscillatory electrical signal and a second tone which varies in loudness proportionally with the voltage of said oscillatory electrical signal when the frequency of said oscillatory electrical signal exceeds a predetermined value.

9. An amusement device according to claim 8, further comprising:

a light generating means responsive to said electrical signal for producing a light response which synchronously varies with the repeated flexure of said blade.

10. An amusement device according to claim 8 wherein said flexible piezoelectric element is a piezoelectric polymer film having opposed electroconductive surfaces.

11. An amusement device according to claim 10 wherein said flexible piezoelectric element is integrally formed within said blade.

12. An amusement device according to claim 10 wherein said piezoelectric polymer film with opposed electroconductive surfaces is folded such that one of said opposed electroconductive surfaces is in a face-to-face relationship and a portion of the other said opposed electroconductive surfaces is attached to said blade.

* * * * *